US012392265B2

(12) United States Patent
Bruce et al.

(10) Patent No.: US 12,392,265 B2
(45) Date of Patent: Aug. 19, 2025

(54) HYDRAULIC VARIABLE CAMSHAFT TIMING WITH A TEMPERATURE BASED HYDRAULIC SWITCH

(71) Applicant: BorgWarner Inc., Auburn Hills, MI (US)

(72) Inventors: Adam Bruce, Ithaca, NY (US); Keith Feldt, Ithaca, NY (US); Braman Wing, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 18/197,997

(22) Filed: May 16, 2023

(65) Prior Publication Data

US 2023/0366334 A1 Nov. 16, 2023

Related U.S. Application Data

(60) Provisional application No. 63/342,307, filed on May 16, 2022.

(51) Int. Cl.
*F01L 1/344* (2006.01)

(52) U.S. Cl.
CPC ... *F01L 1/3442* (2013.01); *F01L 2001/34423* (2013.01); *F01L 2001/34426* (2013.01); *F01L 2001/34433* (2013.01); *F01L 2001/34453* (2013.01)

(58) Field of Classification Search
CPC ... F01L 2001/34433; F01L 2001/34423; F01L 2800/01; F01L 1/3442; F01L 2001/34426; F01L 2001/3443
See application file for complete search history.

(56) References Cited

U.S. PATENT DOCUMENTS 5,263,443 A * 11/1993 Schechter ..... F01L 1/34409 123/90.31
2002/0062803 A1* 5/2002 Sato ..... F01L 1/3442 123/90.15
2007/0017463 A1* 1/2007 Mott ..... F01L 1/3442 123/90.17
2007/0251477 A1* 11/2007 Nozawa ..... F01L 1/3442 123/90.17
2013/0008397 A1* 1/2013 Takada ..... F01L 1/34 123/90.11

(Continued)

FOREIGN PATENT DOCUMENTS

CN 101952560 A * 1/2011 ..... F01L 1/3442
DE 102006059656 A1 * 7/2007 ..... F01L 1/3442

(Continued)

OTHER PUBLICATIONS

WO-2015111388-A1, English Language Machine Translation (Year: 2015).*

*Primary Examiner* — Wesley G Harris
(74) *Attorney, Agent, or Firm* — Reising Ethington P.C.

(57) ABSTRACT

A hydraulic variable camshaft timing (VCT) assembly including a stator having at least one fluid chamber; and a rotor, received by and angularly displaceable relative to the stator, having at least one vane positioned within the fluid chamber extending radially outwardly from a hub, and a hydraulic switch assembly positioned in the rotor to regulate a flow of fluid between an advancing chamber and a retarding chamber through the vane.

13 Claims, 8 Drawing Sheets

(56) References Cited

U.S. PATENT DOCUMENTS

| | | | | |
|---|---|---|---|---|
| 2014/0244141 | A1* | 8/2014 | Strehlau | F02D 41/062<br>701/113 |
| 2016/0130988 | A1* | 5/2016 | Smith | F01L 1/34409<br>123/90.17 |
| 2021/0324771 | A1* | 10/2021 | Barve | F01L 1/3442 |

FOREIGN PATENT DOCUMENTS

| | | | | |
|---|---|---|---|---|
| DE | 102014210360 | A1 * | 12/2015 | F01L 1/344 |
| EP | 1371817 | A2 * | 12/2003 | F01L 1/022 |
| EP | 1705345 | A1 * | 9/2006 | F01L 1/34 |
| EP | 2133517 | A1 * | 12/2009 | F01L 1/34 |
| FR | 3080147 | A1 * | 10/2019 | F01L 1/3442 |
| WO | WO-2015111388 | A1 * | 7/2015 | F01L 1/047 |
| WO | WO-2018219386 | A1 * | 12/2018 | F01L 1/3442 |

* cited by examiner

HYDRAULIC VARIABLE CAMSHAFT TIMING WITH A TEMPERATURE BASED HYDRAULIC SWITCH

TECHNICAL FIELD

The present application relates to internal combustion engines (ICEs) and, more particularly, to variable camshaft timing used with ICEs.

BACKGROUND

Internal combustion engines (ICEs) use one or more camshafts to open and close intake and exhaust valves in response to cam lobes selectively actuating valve stems as the camshaft(s) rotate and overcome the force of valve springs that keep the valves seated. The shape and angular position of the cam lobes can impact the operation of the ICE. In the past, the angular position of the camshaft relative to the angular position of the crankshaft was fixed. But performance can be improved by varying the angular position of the camshaft relative to the crankshaft using variable camshaft timing (VCT) technologies. VCT technologies can be implemented using VCT devices (sometimes referred to as camshaft phasers) that change the angular position of the camshaft relative to the crankshaft. These camshaft phasers can be hydraulically-actuated. With respect to hydraulically-actuated camshaft phasers, the speed at which the angular position of the camshaft changes relative to the crankshaft can also affect ICE performance. It would be helpful to implement a camshaft phaser that changes the angular position of the camshaft relative to the crankshaft more quickly, especially at lower temperatures.

SUMMARY

In one implementation, a hydraulic variable camshaft timing (VCT) assembly includes a stator having at least one fluid chamber; and a rotor, received by and angularly displaceable relative to the stator, having at least one vane positioned within the fluid chamber extending radially outwardly from a hub, and a hydraulic switch assembly positioned in the rotor to regulate a flow of fluid between an advancing chamber and a retarding chamber through the vane.

In one implementation, a hydraulic VCT assembly includes a stator having at least one fluid chamber; a rotor, received by and angularly displaceable relative to the stator, having at least one vane positioned within the fluid chamber extending radially outwardly from a hub, and a hydraulic switch assembly positioned in the rotor to prevent a flow of fluid between an advancing chamber and a retarding chamber at or below a predetermined temperature and permit the flow of fluid between the advancing chamber and the retarding chamber above the predetermined temperature.

In one implementation, a hydraulic VCT assembly includes a stator having at least one fluid chamber; a rotor, received by and angularly displaceable relative to the stator, having at least one vane positioned within the fluid chamber extending radially outwardly from a hub, and a hydraulic switch assembly positioned in the rotor to regulate a flow of fluid between an advancing chamber and a retarding chamber through the vane; and a contorted fluid path, in fluid communication with the hydraulic switch assembly, sized and shaped so that fluid flow from a fluid source maintains a fluid valve in a position that permits fluid flow between the advancing chamber and the retarding chamber at or below a predetermined temperature and prevents fluid flow between the advancing chamber and the retarding chamber above the predetermined temperature.

DETAILED DESCRIPTION

A hydraulic variable camshaft timing (VCT) phaser assembly includes a hydraulic switch assembly that permits the flow of fluid between two or more chambers in the phaser when the fluid exists at or below a predetermined temperature but prevents the flow of fluid once the fluid exceeds that temperature. In previous VCT phasers, the speed at which the phaser angularly displaced a camshaft relative to a crankshaft may be limited by fluid in a chamber. For example, if the VCT phaser is advancing, restricted fluid flow exiting a retarding chamber may limit the speed at which fluid can enter an advancing chamber, and vice-versa. Phasing speed can be particularly limited at lower fluid temperatures. But as fluid temperature rises with internal combustion engine temperature, the fluid, such as engine oil, becomes less viscous and fluid flow increases. However, too much flow can result in unwanted oscillations of a rotor.

The hydraulic VCT phaser assembly having the hydraulic switch assembly disclosed here includes a contorted fluid path in fluid communication with one or more fluid switches. The contorted fluid path is sized and shaped such that fluid flow from a fluid source maintains a fluid valve in a position that permits flow of fluid between an advancing chamber and a retarding chamber at or below a predetermined temperature and prevents the flow of fluid between the advancing chamber and the retarding chamber above that temperature. Implementations disclosed here depict the hydraulic valve assembly to include two fluid logic valves, however, other implementations are possible that use only one.

Figure 1:
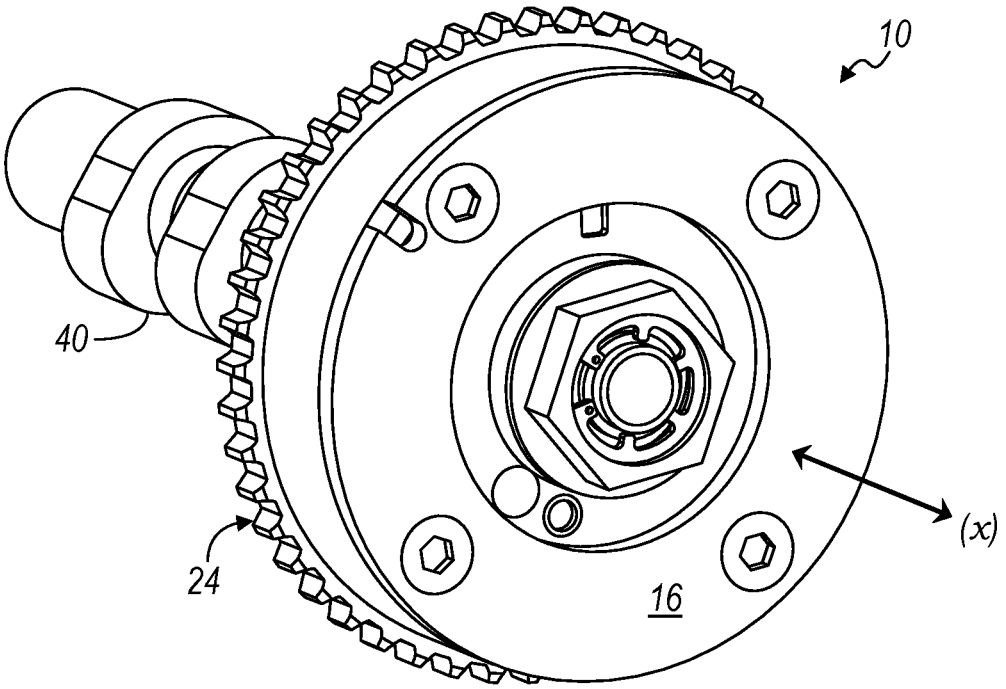
FIG. 1 is a perspective view depicting an implementation of a hydraulic variable camshaft timing (VCT) phaser assembly with a hydraulic switch assembly.
Figure 2:
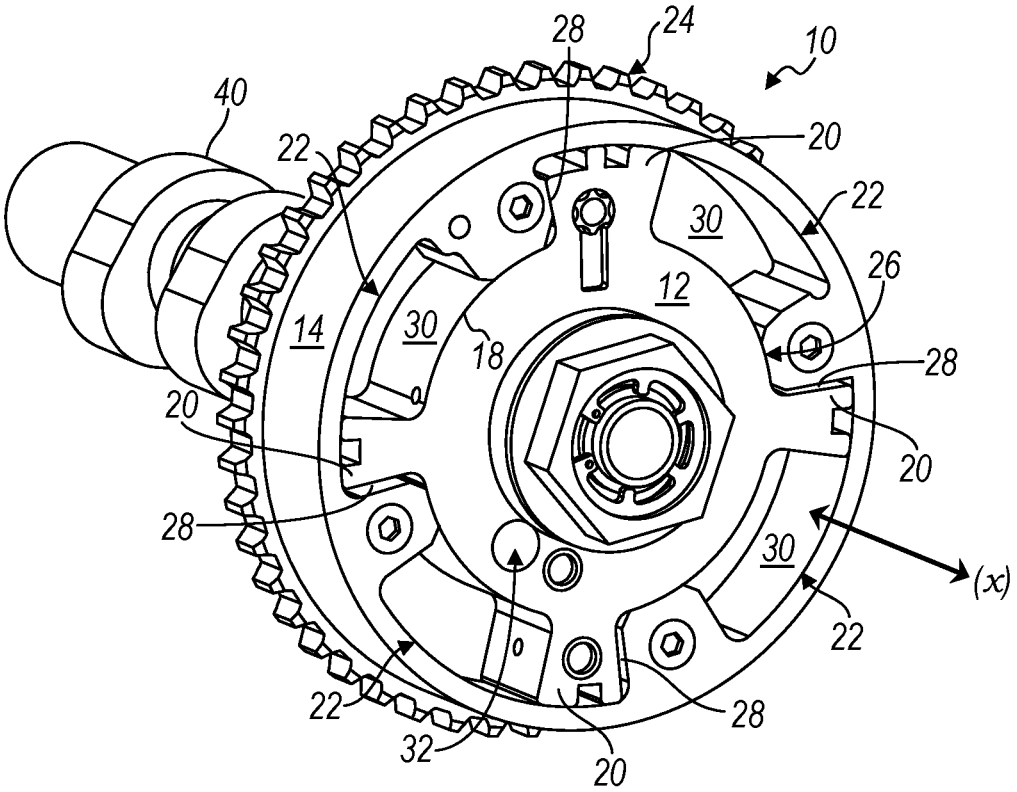
FIG. 2 is another perspective view depicting an implementation of a hydraulic VCT phaser assembly with a hydraulic switch assembly.
Figure 3A:
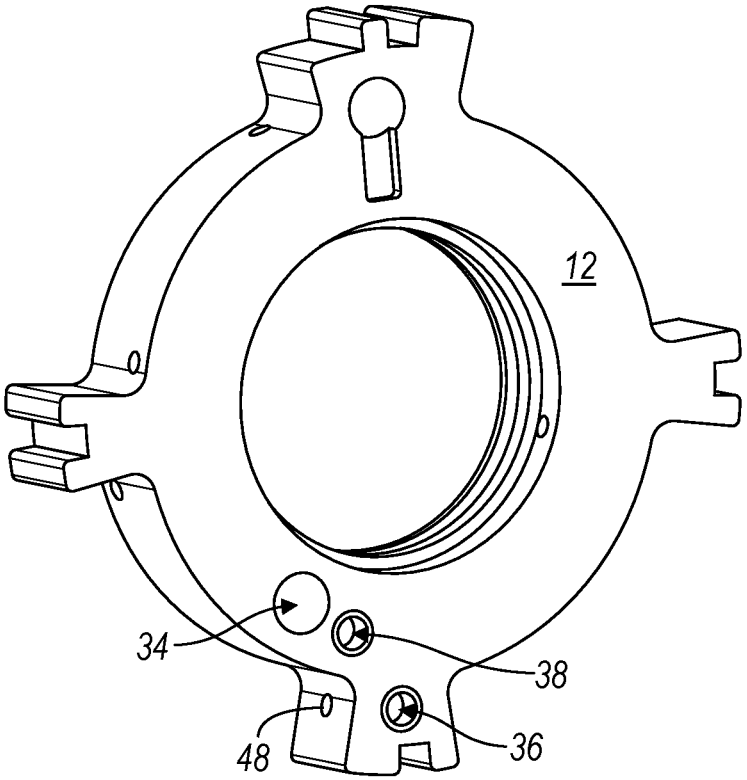
FIG. 3*a* is a perspective view depicting an implementation of a rotor used with a hydraulic VCT phaser assembly and a hydraulic switch assembly.
Figure 3B:
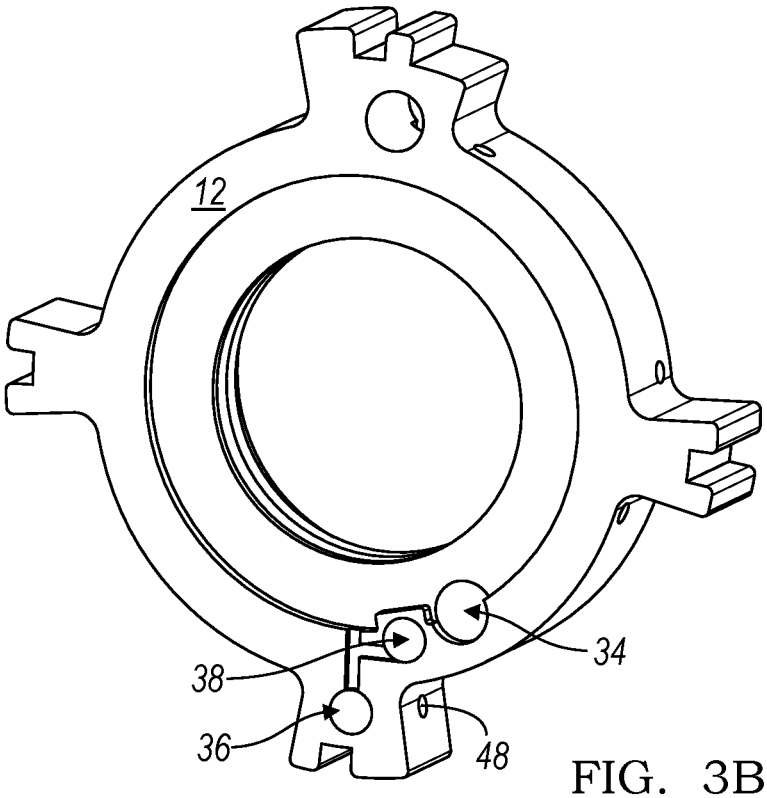
FIG. 3*b* is another perspective view depicting an implementation of a rotor used with a hydraulic VCT phaser assembly and a hydraulic switch assembly.
Figure 4:
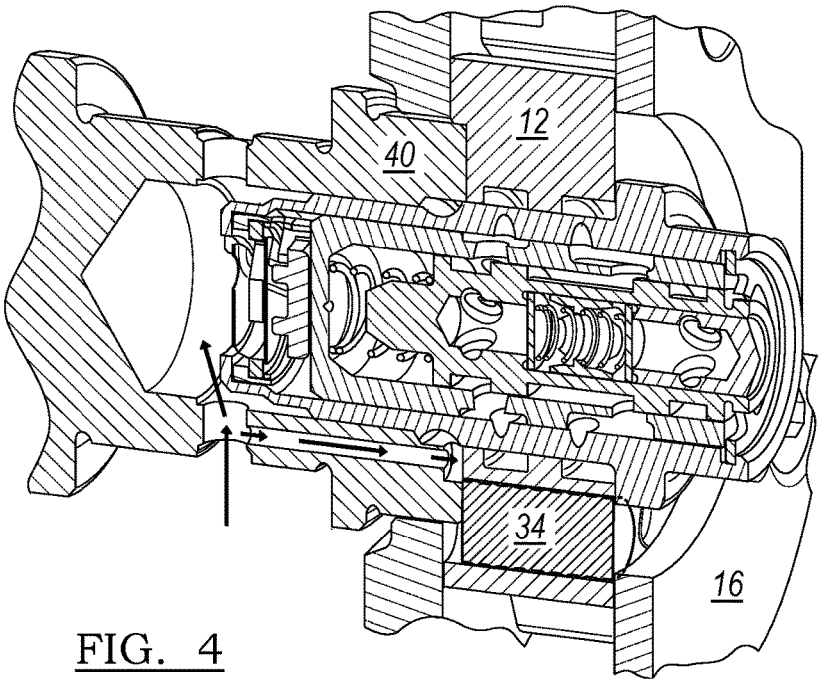
FIG. 4 is a cross-sectional view depicting an implementation of a hydraulic VCT phaser assembly and a hydraulic switch assembly.
Figure 5A:
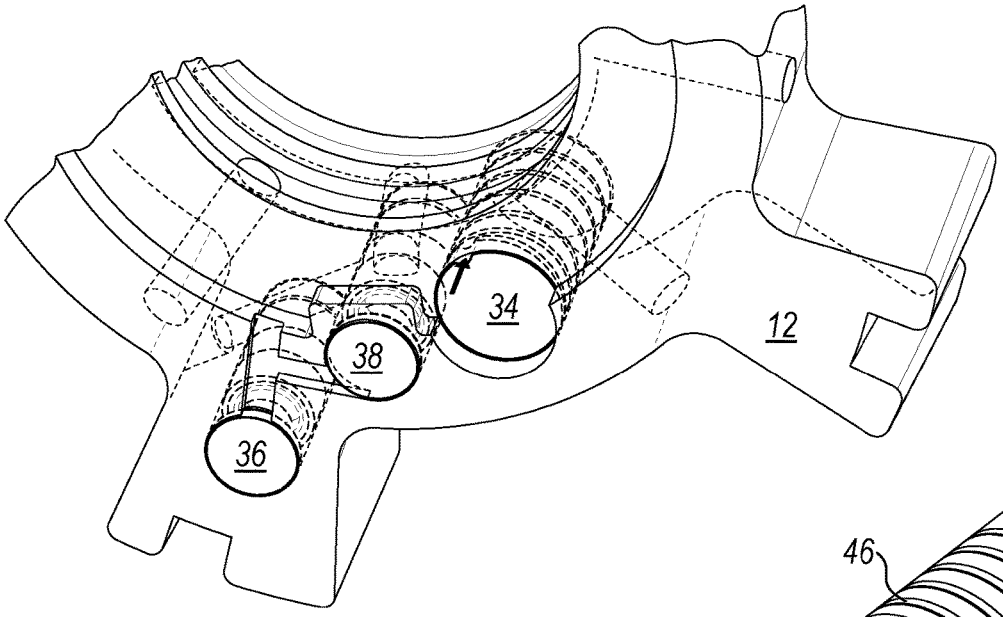
FIG. 5*a* is another perspective view depicting an implementation of a rotor used with a hydraulic VCT phaser assembly and a hydraulic switch assembly.
Figure 5B:
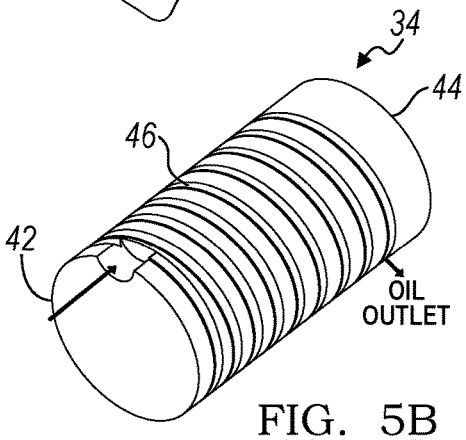
FIG. 5*b* is a perspective view depicting a portion of an implementation of a hydraulic VCT phaser assembly and a hydraulic switch assembly.
Figure 6A:
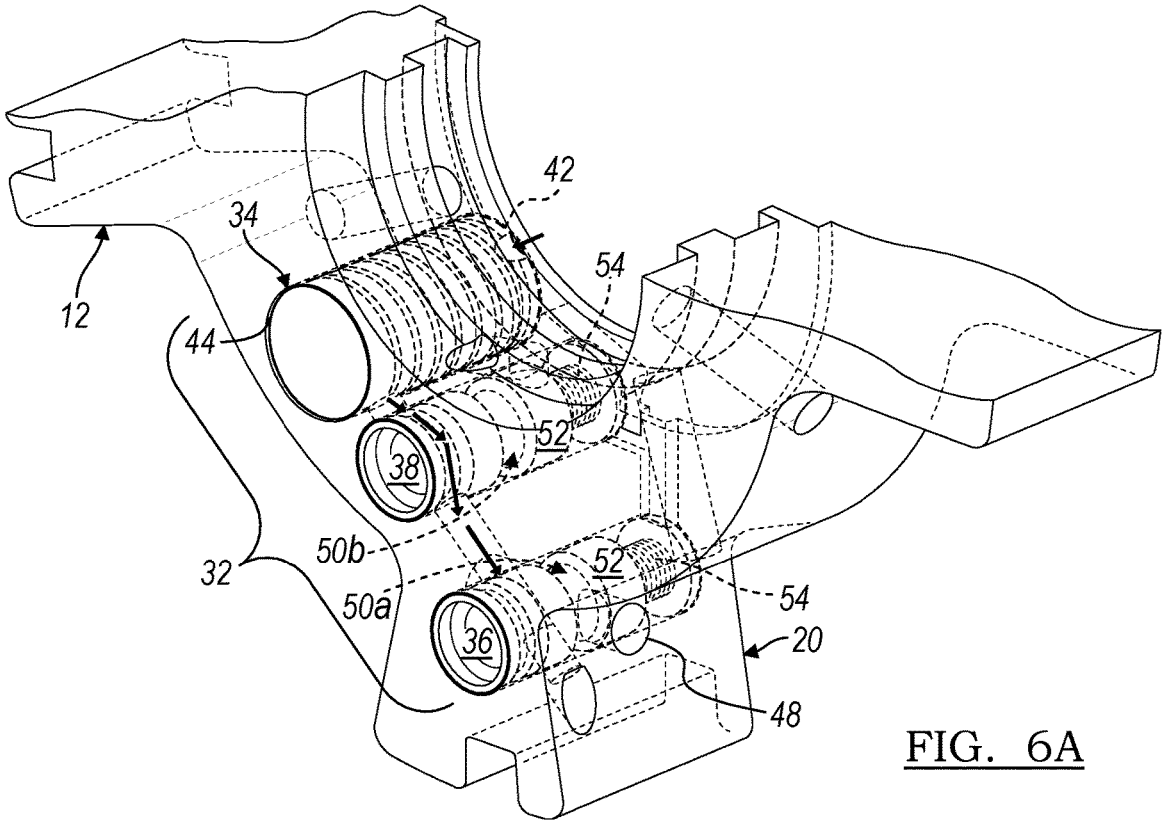
FIG. 6*a* is a cross-sectional view depicting an implementation of a rotor used with a hydraulic VCT phaser assembly and a hydraulic switch assembly.
Figure 6B:
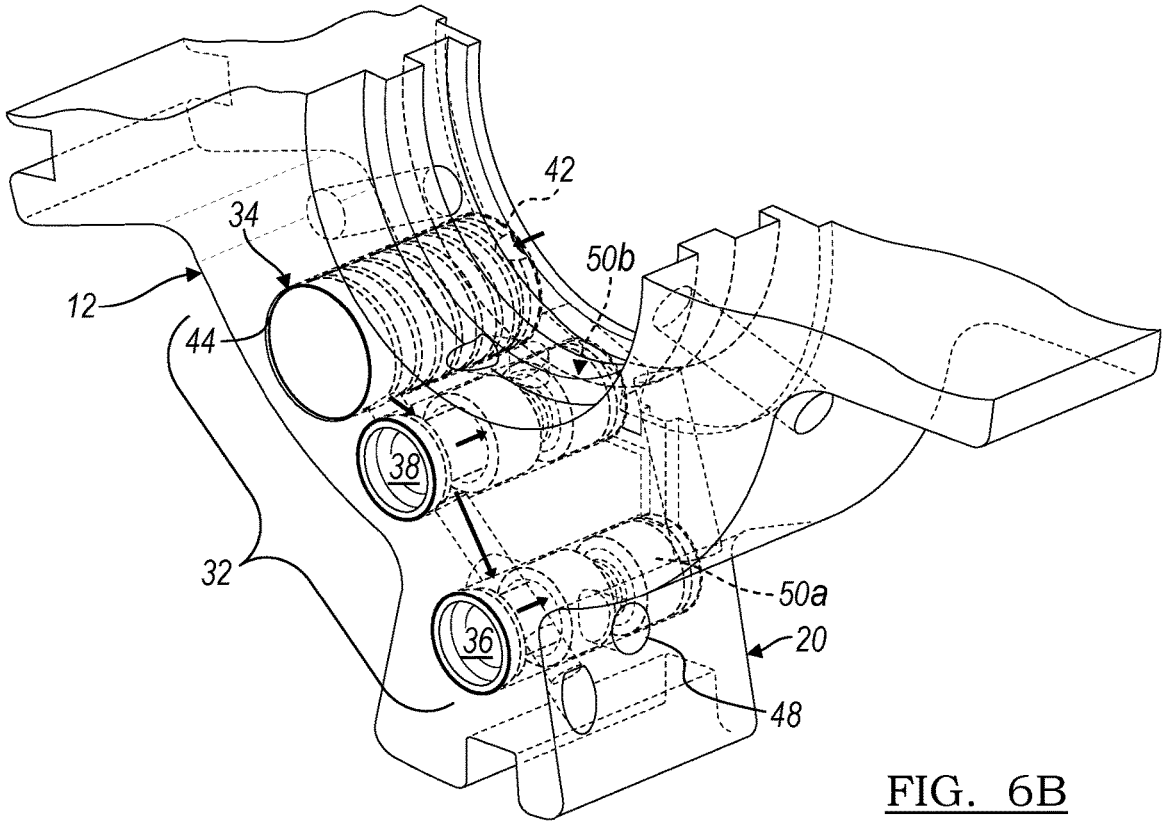
FIG. 6*b* is another cross-sectional view depicting a portion of an implementation of a hydraulic VCT phaser assembly and a hydraulic switch assembly.
Figure 7A:
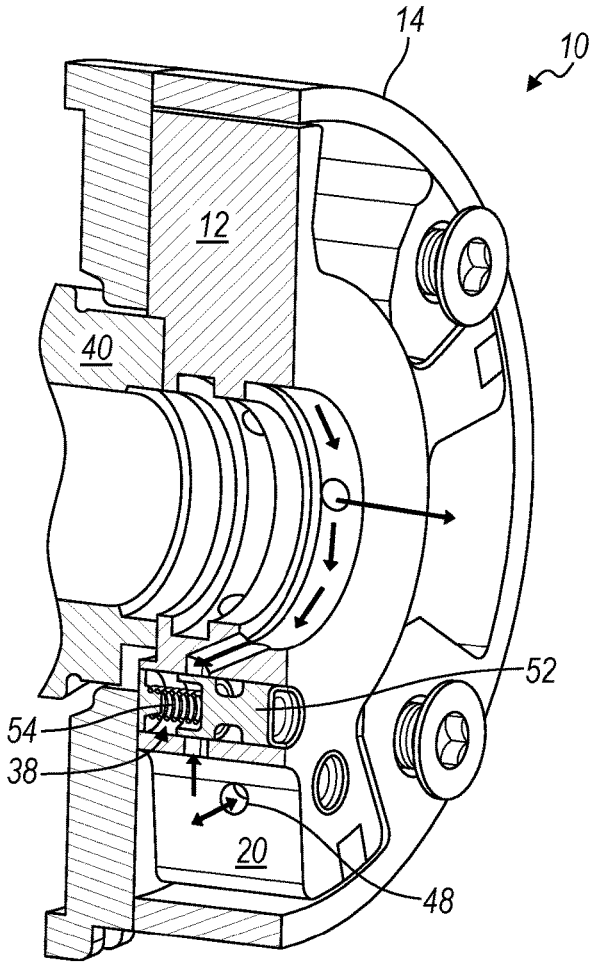
FIG. 7*a* is a cross-sectional view depicting an implementation of a hydraulic VCT phaser assembly and a hydraulic switch assembly.
Figure 7B:
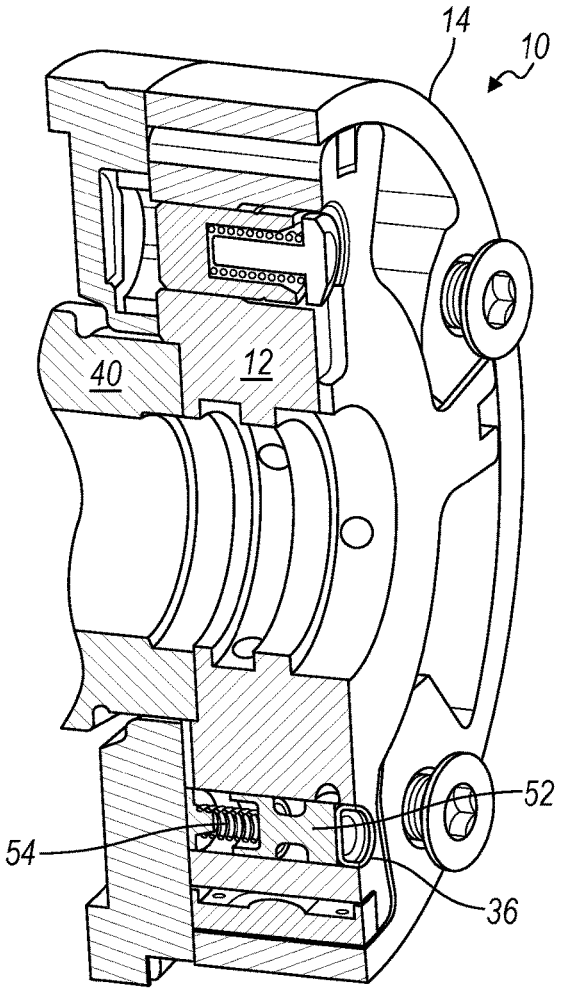
FIG. 7*b* is another cross-sectional view depicting an implementation of a hydraulic VCT phaser assembly with a hydraulic switch assembly.
Figure 8A:
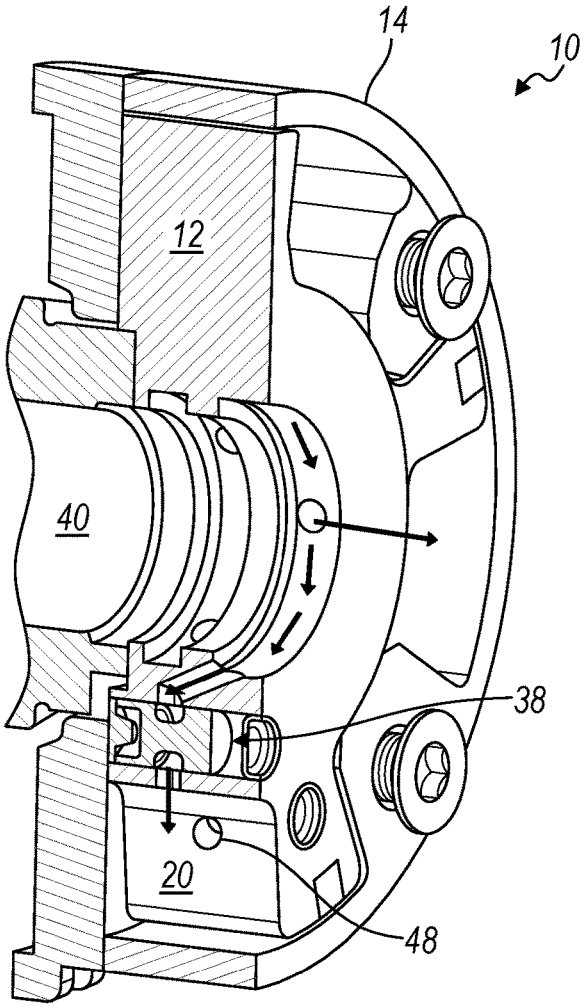
FIG. 8*a* is another cross-sectional view depicting an implementation of a hydraulic VCT phaser assembly and a hydraulic switch assembly.
Figure 8B:
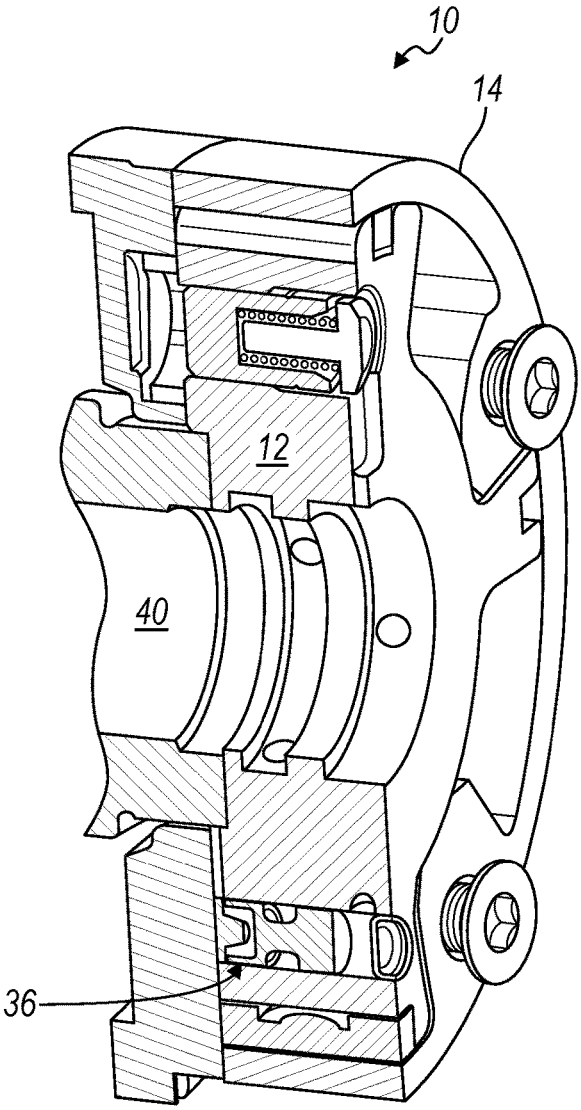
FIG. 8*b* is another cross-sectional view depicting an implementation of a hydraulic VCT phaser assembly and a hydraulic switch assembly.

An implementation of a VCT phaser assembly in the form of a hydraulically-controlled camshaft phaser 10 is shown in FIGS. 1-2. An example of a hydraulically-controlled camshaft phaser is described in U.S. Pat. No. 8,356,583, the contents of which are hereby incorporated by reference. The phaser includes a rotor 12, a stator 14, and an end plate 16. The rotor 12 has a hub 18 with vanes 20 that extend radially outwardly away from the hub 18 and an axis of rotation (x). Apart from the vanes 20, the rotor 12 can include one or more fluid chambers 22 for selectively communicating fluid toward between fluid chambers 22 as well as with a fluid supply and a fluid tank (not shown). The hub 18 can be rigidly coupled to a distal end of a camshaft in a way that the rotor 12 and the camshaft are not angularly displaced relative to each other.

The stator 14 can include a camshaft sprocket 24 on a radially-outer surface of the stator 14. The camshaft sprocket 24 can engage an endless loop, such as a chain, that also engages a crankshaft sprocket that transmits rotational force from the crankshaft to the stator 14. The rotor 12 can be positioned within the stator 14 to rotate relative to the stator 14 and angularly displace the rotor 12 relative to the stator 14 and change the phase of the camshaft relative to the crankshaft. The rotor 12 can be received within a stator cavity 26 formed within the stator 14 such that the vanes 20 extend into fluid chambers 22 formed within the stator cavity 26. The fluid chambers 22 are located radially-outwardly from the hub 18 such that each vane 20 can divide the fluid chamber 22 into an advancing chamber portion 28 and a retarding chamber portion 30. The rotor 12 can rotate about the axis of rotation (x) within the stator cavity 26 in response to fluid supplied to or exiting from the advancing or retarding chamber portions 28, thereby changing the angular position of the camshaft relative to the angular position of the stator 14.

The rotor 12 is shown with a hydraulic switch assembly 32 in more detail in FIGS. 3-8. The hydraulic switch assembly 32 includes a contorted fluid path 34, a short logic valve 36, and a chamber logic valve 38. Fluid can be supplied from a fluid source (not shown) through a camshaft 40 to the contorted fluid path 34. The contorted fluid path 34 can be a non-linear fluid path from an inlet 42 to an outlet 44 that at least somewhat impedes fluid flow at lower temperatures when fluid, such as engine oil, is more viscous than at higher temperatures. The contorted fluid path 34 in one implementation can be a circular cross-sectioned rod or plug having fluid channels formed on an outer radial surface. However, it should be appreciated that the contorted fluid path 34 can be implemented in a variety of different ways. For example, the contorted fluid path can be defined by the threads of a center bolt used to house a spool valve that controls phasing of the camshaft phaser. Or in another example, the contorted fluid path can be etched into a rotor or an end plate face. The fluid channels 46 can extend from the inlet 42 to the outlet 44. As fluid enters the inlet 42, the rate at which the fluid flows can be reduced at lower engine temperatures. As the fluid temperature rises, so too can the rate at which the fluid flows through the contorted fluid path 34.

The fluid exiting the outlet 44 can then be communicated to the short logic valve 36 and the chamber logic valve 38. The chamber logic valve 38 selectively permits the flow of fluid to the advancing chamber portion 28 or the retarding chamber portion 30 based on the rate of fluid flow through the contorted fluid path 34. The short logic valve 36 selectively permits the flow of fluid between advancing and retarding chamber portions 28, 30 based on the rate of fluid flow through the contorted fluid path 34. The short logic valve 36 can control the flow of fluid through the vane 20 via a shorting fluid path 48. The short logic valve 36 and the chamber logic valve 38 can be linearly movable spool valves extending parallel with an axis of camshaft rotation, having spools 50 with one or more lands 52, that are biased into a default position by a spring 54 or another biasing member. The default position of the short logic valve 36 can permit the flow of fluid through the shorting fluid path 48 between the advancing chamber portion 28 and the retarding chamber portion 30 while the default position of the chamber logic valve 38 can prevent the flow of fluid from a control valve to either the advancing or retarding chamber portions 28, 30. As fluid flow through the contorted fluid path 34 increases along with engine temperature, the flow can exert sufficient linear force on the spool 50 to overcome the bias of the spring 54 and move the spool 50 linearly. The short logic valve 36 can then have a spool 50*a* with lands 52 that move to prevent the flow of fluid through the shorting fluid path 48. And the increased fluid flow can move the spool 50*b* of the chamber logic valve 38 so that the lands 52 no longer prevent the flow of fluid from the contorted fluid path 34 to the advancing or retarding chamber portions 28, 30.

After the engine is turned off, the springs 54 included in the short logic valve 36 and the chamber logic valve 38 can move the spools 50 back to their default positions and fluid flow can reverse moving fluid toward the contorted fluid path 34 and the fluid source. The reversed flow of fluid can move the fluid from the fluid outlet 44 and towards the inlet 42. This can help if the engine were to stall as the logic valves 36, 38 would resist losing fluid pressure thereby facilitating a restart. The hydraulic switch assembly 32, including the fluid paths and the logic valves, can be tuned to desired performance attributes based on variable such as fluid channel size and size/shape of logic valves.

Figure 9A:
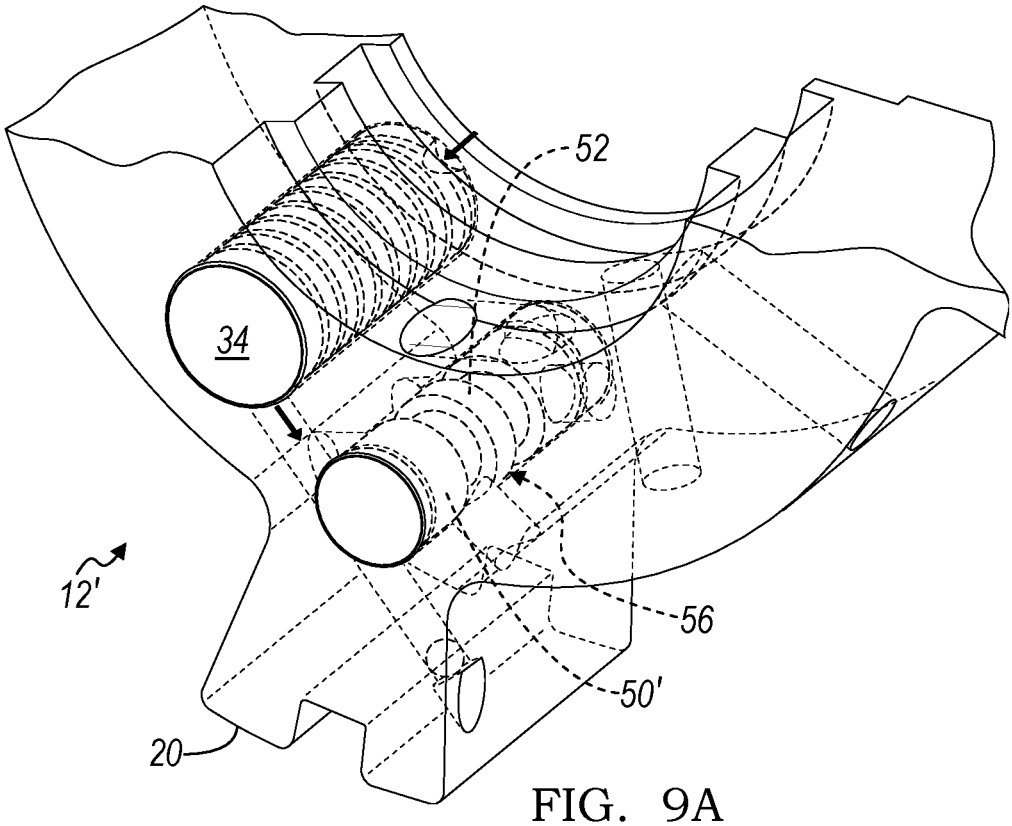
FIG. 9*a* is another cross-sectional view depicting an implementation of a rotor used with a hydraulic VCT phaser assembly and a hydraulic switch assembly.
Figure 9B:
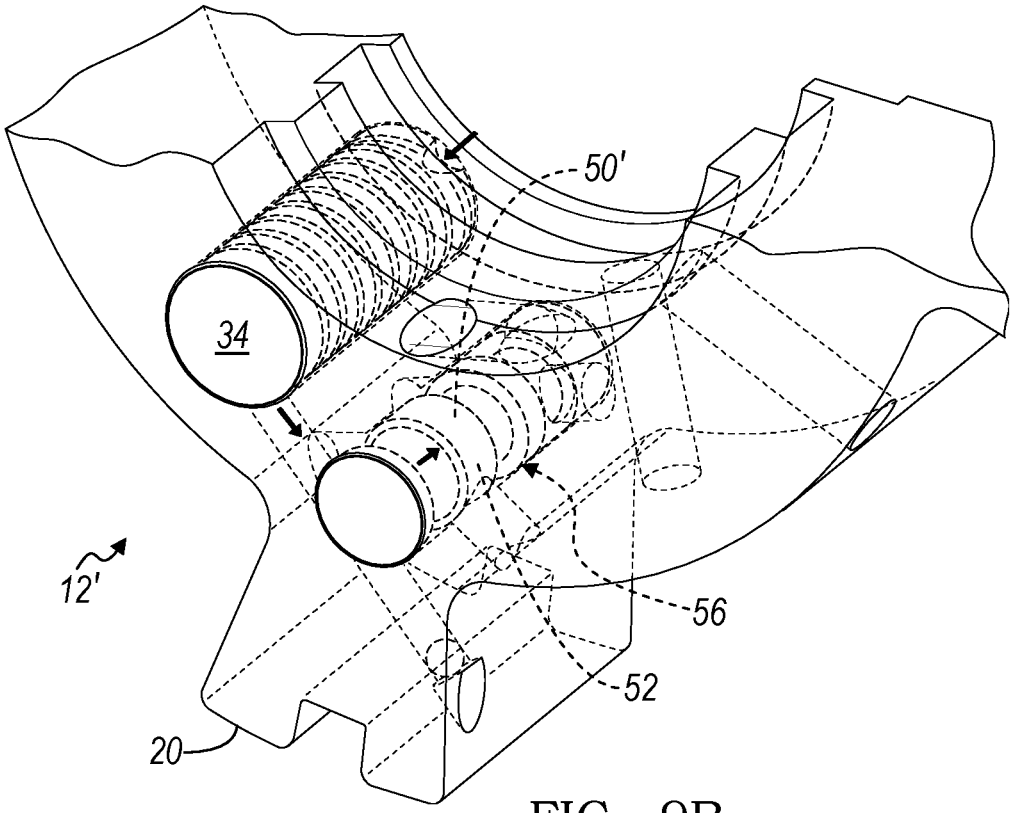
FIG. 9*b* is another cross-sectional view depicting an implementation of a rotor used with a hydraulic VCT phaser assembly and a hydraulic switch assembly.
Figure 10:
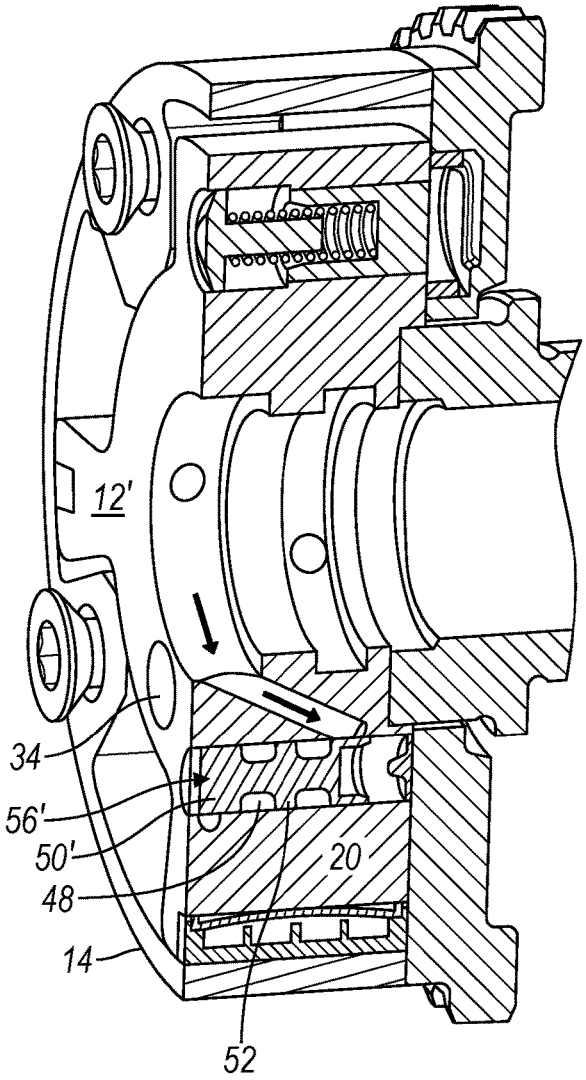
FIG. 10 is another cross-sectional view depicting an implementation of a hydraulic VCT phaser assembly with a hydraulic switch assembly.
Figure 11:
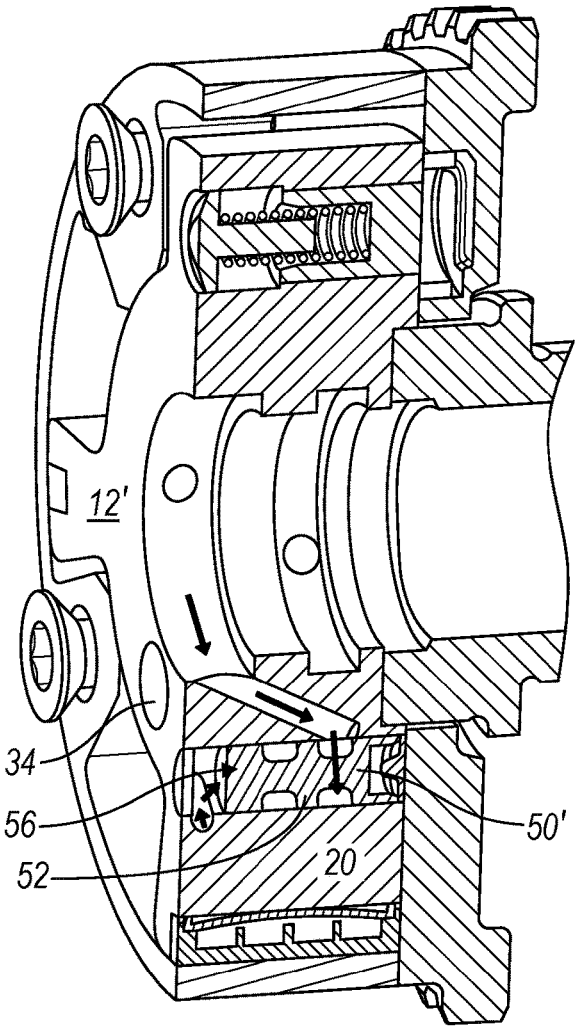
FIG. 11 is another cross-sectional view depicting an implementation of a hydraulic VCT phaser assembly with a hydraulic switch assembly.

Another implementation of a hydraulic switch assembly including no more than one fluid logic valve is shown. The assembly may be included with a rotor 12' having a somewhat longer axial length measured along an axis of camshaft rotation relative to embodiments of the assembly including two or more fluid logic valves. The rotor 12' can include a dual logic valve 56 extending along an axial length of the rotor 12' that can control the flow of fluid through the shorting fluid path 48 between the advancing and retarding chamber portions 28, based on the rate of fluid flow through the contorted fluid path 34 as well as the flow of fluid from a control valve to either the advancing or retarding chamber portions 28, 30. The dual logic valve 56 can include a spool 50' having lands 52 that move linearly to permit or restrict the flow of fluid through shorting fluid path 48 and fluid to the advancing and retarding chamber portions 28, 30. FIGS. 9*a* and 10 depict the spool 50' biased into a default position by a spring when fluid temperature is relatively low. The spool 50' permits the flow of fluid through the shorting fluid path 48. As the internal combustion engine warms and the fluid becomes less viscous, the rate of fluid flow through the contorted fluid path 34 can increase thereby overcoming the spring bias and linearly move the spool 50' so that the flow of fluid through the shorting fluid path is prevented while fluid flow to the advancing and retarding chamber portions 28, 30 is permitted, as shown in FIGS. 9*b* and 11.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A hydraulic variable camshaft timing (VCT) assembly, comprising:

a stator having at least one fluid chamber; and a rotor, received by and angularly displaceable relative to the stator, having at least one vane positioned within the at least one fluid chamber extending radially outwardly from a hub, and a contorted fluid path positioned in the rotor to regulate a flow of fluid between an advancing chamber and a retarding chamber, further comprising a chamber logic valve that controls a flow of fluid to the advancing chamber or the retarding chamber based on a rate of fluid flow through the contorted fluid path and a short logic valve that controls a flow of fluid through a shorting fluid path, wherein the contorted fluid path selectively impedes the flow of fluid through the contorted fluid path depending on temperature.

2. The hydraulic VCT assembly recited in claim 1, wherein the contorted fluid path impedes the flow of fluid within the at least one fluid chamber at lower temperatures.

3. The hydraulic VCT assembly recited in claim 2, wherein the contorted fluid path comprises a rod or plug having fluid channels formed on an outer radial surface.

4. The hydraulic VCT assembly recited in claim 1, wherein the short logic valve and the chamber logic valve comprise spool valves.

5. The hydraulic VCT assembly recited in claim 4, wherein the spool valves are biased by springs in a position that permits fluid flow.

6. The hydraulic VCT assembly recited in claim 4, wherein the short logic valve and the chamber logic valve move linearly parallel with an axis of camshaft rotation.

7. The hydraulic VCT assembly recited in claim 1, further comprising no more than one fluid logic valve.

8. A hydraulic variable camshaft timing (VCT) assembly, comprising:

a stator having at least one fluid chamber;

a rotor, received by and angularly displaceable relative to the stator, having at least one vane positioned within the at least one fluid chamber extending radially outwardly from a hub, and a contorted fluid path positioned in the rotor further comprising a dual logic valve that controls a flow of fluid through a shorting fluid path between advancing and retarding chambers based on a rate of fluid flow through the contorted fluid path as well as a flow of fluid from a control valve to either the advancing chamber or retarding chamber to prevent a flow of fluid between the advancing chamber and the retarding chamber at or below a predetermined temperature and permit the flow of fluid between the advancing chamber and the retarding chamber above the predetermined temperature.

9. The hydraulic VCT assembly recited in claim 8, wherein the contorted fluid path comprises a rod or plug having fluid channels formed on an outer radial surface.

10. The hydraulic VCT assembly recited in claim 8, further comprising a short logic valve and a chamber logic valve.

11. The hydraulic VCT assembly recited in claim 10, wherein the short logic valve and the chamber logic valve comprise spool valves.

12. The hydraulic VCT assembly recited in claim 11, wherein the spool valves are biased by springs in a position that permits fluid flow.

13. The hydraulic VCT assembly recited in claim 8, further comprising no more than one fluid logic valve.

* * * * *